United States Patent [19]

Voorheis

[11] Patent Number: 4,652,234

[45] Date of Patent: Mar. 24, 1987

[54] CONSTANT PRESSURE-VARIABLE ORIFICE BURNER NOZZLE ASSEMBLY

[75] Inventor: James T. Voorheis, Essex Fells, N.J.

[73] Assignee: Voorheis Industries, Inc., Fairfield, N.J.

[21] Appl. No.: 805,591

[22] Filed: Dec. 9, 1985

Related U.S. Application Data

[63] Continuation of Ser. No. 585,087, Mar. 1, 1984, abandoned.

[51] Int. Cl.[4] ..... F23Q 9/08

[52] U.S. Cl. ..... 431/281; 431/284; 239/562

[58] Field of Search ..... 431/114, 182, 183, 174, 431/181, 186, 187, 178, 188, 189, 284, 353, 346, 11, 281; 239/456, 562, 413, 419.3

[56] References Cited

U.S. PATENT DOCUMENTS

| | | | |
|---|---|---|---|
| 733,693 | 4/1903 | Blandon | 431/11 |
| 775,156 | 11/1904 | Ullmann | 239/456 |
| 1,024,596 | 4/1912 | Oakley | 431/189 |
| 1,561,809 | 11/1925 | Valerius | 239/460 |
| 1,589,546 | 5/1926 | Jones | 431/187 |
| 1,696,196 | 12/1928 | Gray | 239/456 |
| 1,731,090 | 10/1929 | Beeby | 239/456 |
| 1,753,613 | 4/1930 | McCoy | 239/461 |
| 1,774,953 | 9/1930 | Titmas et al. | 239/113 |
| 1,781,236 | 11/1930 | Lilge | 431/352 |
| 1,788,495 | 1/1931 | Sheppard | 239/399 |
| 1,844,151 | 2/1932 | Friedman | 239/419 |
| 1,879,916 | 9/1932 | Bagley | 431/174 |
| 1,903,100 | 3/1933 | Esterling | 239/456 |
| 2,003,827 | 6/1935 | Esterling | 239/456 |
| 2,185,886 | 1/1940 | Caldwell | 239/417 |
| 2,290,785 | 7/1942 | Turpin | 239/414 |
| 2,303,648 | 12/1942 | Lemster et al. | 239/419.3 |
| 2,526,748 | 10/1950 | Hill | 239/417 |
| 2,978,188 | 4/1961 | Fredrikson | 239/562 X |
| 3,182,446 | 5/1965 | Kamin ski | 239/456 |
| 3,243,127 | 3/1966 | Watson | 239/562 |
| 3,771,944 | 11/1973 | Houis et al. | 431/284 |
| 4,285,664 | 8/1981 | Voorheis | 431/350 X |

FOREIGN PATENT DOCUMENTS

| | | | |
|---|---|---|---|
| 786155 | 4/1935 | France | 239/562 |
| 48207 | 7/1982 | Japan | 431/350 |
| 161411 | 10/1982 | Japan | 431/157 |
| WO81/01668 | 6/1981 | PCT Int'l Appl. | 239/562 |
| 1441750 | 7/1976 | United Kingdom | 431/284 |
| 47905 | 5/1979 | U.S.S.R. | 239/562 |

*Primary Examiner*—Randall L. Green
*Attorney, Agent, or Firm*—David A. Jackson

[57] ABSTRACT

In a burner gun of the type including a conduit having a gas inlet supplied with a gas and a outlet, a burner nozzle assembly includes an outlet plate secured to the outlet of the gas conduit and having a plurality of circumferentially arranged orifices and an external end face centrally of said orifices which forms a bluff body; an adjustable cylinder having a plurality of frusto-conical orifice plugs secured to an end face thereof and axially movable with respect to the orifices to vary the openings thereof so as to provide a constant velocity gas exiting through the orifices; a guide secured centrally within and to the adjustable cylinder by means of thrust rods and slidably received within a guide sleeve in the outlet plate so as to accurately position the orifice plugs with respect to the orifices; and a piston rod connected to the guide and externally controlled to slidably move the guide within the guide sleeve and thereby control movement of the orifice plugs with respect to the orifices so as to vary the openings of the latter.

18 Claims, 5 Drawing Figures

CONSTANT PRESSURE-VARIABLE ORIFICE BURNER NOZZLE ASSEMBLY

This application is a continuation of application Ser. No. 585,087, filed Mar. 1, 1984, now abandoned.

BACKGROUND OF THE INVENTION

1. Field of the Invention

This invention relates generally to burners for combustible material and, more particularly, is directed a burner nozzle assembly for a gas burner.

2. Description of the Prior Art

With burner assemblies, it is desirable to provide accurate adjustment of the amount of fluid utilized in the burner assembly. To this end, it is known to adjust the oil or gas flow in an oil or gas burner by means of a nozzle having a single orifice plug which is axially movable with respect to the opening of the nozzle. Examples of such arrangements are shown and disclosed in U.S. Pat. No. 1,731,090; 1,774,953; 1,903,100; 2,003,827; 2,290,785; 3,782,884; and 4,152,843.

Arrangements of the above type have not been limited in use with oil or gas burners. For example, U.S. Pat. No. Re. 26,013 and U.S. Pat. Nos. 3,102,691; 3,111,271; and 3,684,192 disclose hose nozzles or the like which also include an orifice plug which is axially movable with respect to the opening of the nozzle for adjusting the flow of liquid therethrough. Of these patents, U.S. Pat. No. 3,684,192 discloses such a nozzle which provides constant pressure, variable flow, regardless of the pressure from the source.

However, it may be difficult to control the amount and pressure of gas in a gas burner with the above arrangements. To do so may require use of the arrangement disclosed in U.S. Pat. No. 3,684,192, which is relatively complicated and which may be impractical in a gas burner assembly.

It is also known to separate a gas stream into a plurality of streams. For example, U.S. Pat. No. 2,914,257 discloses a combination burner nozzle in which a first circumferentially arranged set of apertures is positioned in staggered relation to a second circumferentially arranged set of apertures for dividing the gas or steam from the chamber into a plurality of streams. After being divided into the plurality of streams, the gas passes outward of the apparatus through grooves in the beveled surface of the outlet section.

U.S. Pat. No. 4,285,664 to the same inventor herein discloses a burner for a plurality of fluid streams and is generally of the type to which the present invention is directed. With the burner of this latter apparatus, however, there is no adjustment of the gas pressure or velocity at the outlet side of the burner nozzle. This patent also discloses a bluff body effect which is produced by the flat downstream end of a velocity ring by which a toroidal eddy is produced.

OBJECTS AND SUMMARY OF THE INVENTION

Accordingly, it is an object of this invention to provide a burner nozzle assembly by which the amount of gas emitted from the assembly can be easily and readily controlled without change to the burner upstream pressure.

It is another object of this invention to provide a burner nozzle assembly by which the velocity of the gas emitted from the assembly can be easily and readily maintained without change to the upstream pressure.

It is still another of this invention to provide a burner nozzle assembly which can adjust the gas velocity of the burner nozzle to provide an optimum gas velocity over the entire range of operation by altering the gas supply pressure.

It is yet another object of this invention to provide a burner nozzle assembly which provides uniformity in gas distribution at the outlet thereof.

It is a further object of this invention to provide uniformity in gas distribution at the outlet of the burner nozzle assembly by providing a constant gas velocity at the outlet thereof and a bluff body effect.

It is a still further object of this invention to provide a burner nozzle assembly which provides positive flame retention by means of a bluff body effect with constant upstream gas pressure values in the operating range of 5 PSI to 50 PSI.

In accordance with an aspect of this invention, in a burner gun of the type including conduit means having an inlet and an outlet; and gas inlet means for supplying a gas to the inlet of the conduit means, a burner nozzle assembly includes gas outlet means for emitting the gas supplied to the conduit means, the gas outlet means including a plurality of circumferentially arranged orifices at the outlet of the conduit means; a plurality of orifice plug means, each axially adjustable with respect to a respective one of the orifices; and control means for simultaneously adjusting the plurality of orifice plug means with respect to the plurality of orifices to vary the openings of the plurality of orifices so as to provide a constant gas velocity at the outlet of the conduit means.

In accordance with another aspect of this invention, in a burner gun of the type including conduit means having an inlet and an outlet; and gas inlet means for supplying a gas to the inlet of the conduit means, a burner nozzle assembly includes gas outlet means for emitting the gas supplied to the conduit means, the gas outlet means including a plurality of circumferentially arranged orifices at the outlet of the conduit means; bluff body means positioned centrally of the plurality of orifices; a plurality of orifice plug means, each axially adjustable with respect to a respective one of the orifices; and control means for simultaneously adjusting the plurality of orifice plug means with respect to the plurality of orifices to vary the openings of the plurality of orifices so as to provide a constant gas velocity at the outlet of the conduit means.

The above, and other, objects, features and advantages of the present invention will become readily apparent from the following detailed description thereof which is to be read in connection with the accompanying drawings.

DETAILED DESCRIPTION OF A PREFERRED EMBODIMENT

Figure 1A:
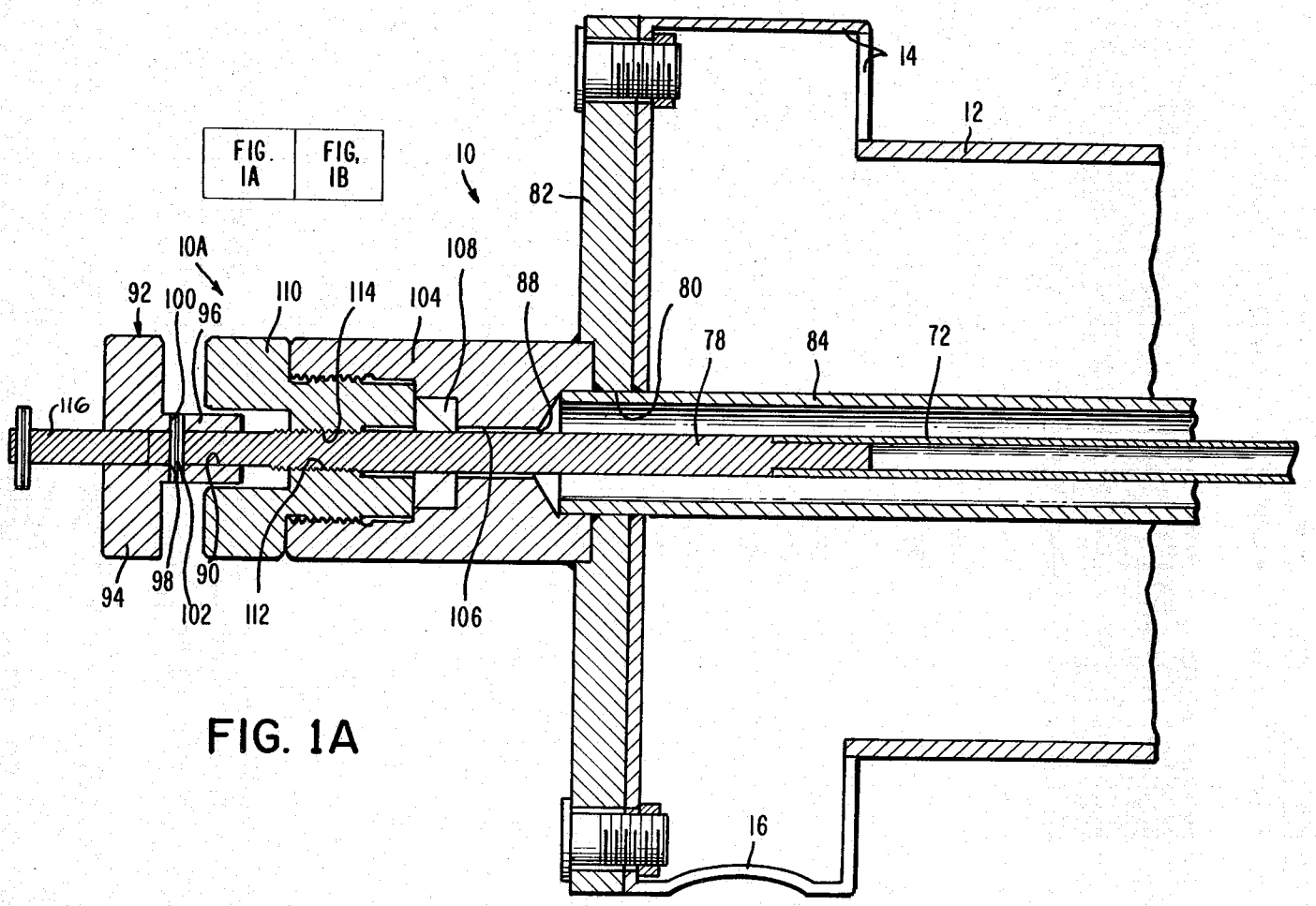
FIG. 1A is a cross-sectional view of the downstream side of a burner gun having a burner nozzle assembly according to one embodiment of the present invention.
Figure 1B:
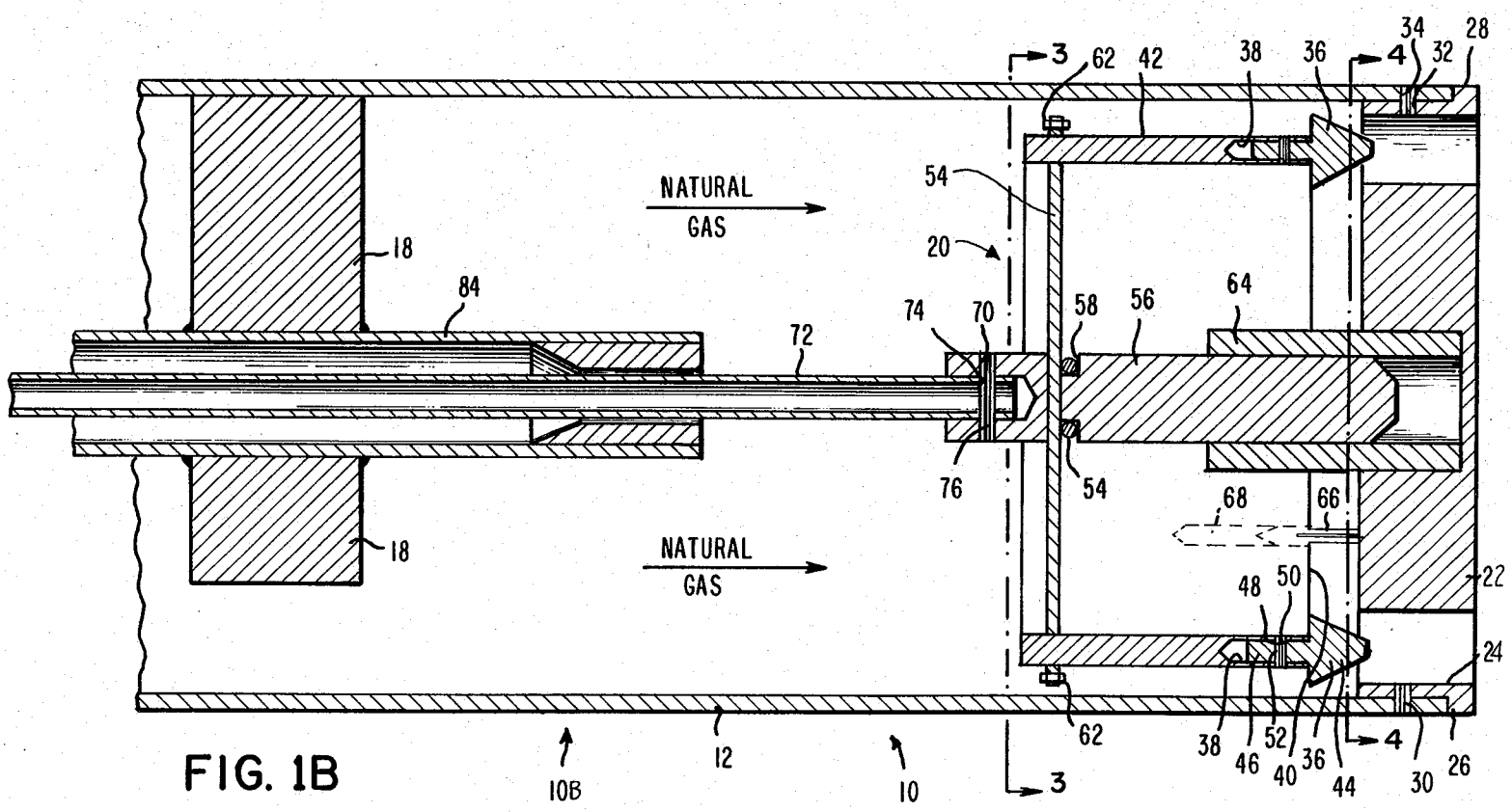
FIG. 1B is a cross-sectional view of the upstream side of the burner gun having the burner nozzle assembly according to one embodiment of the present invention.

Referring to the drawings in detail, and initially to FIGS. 1A and 1B thereof, a burner gun 10 according to one embodiment of the present invention is formed with an inlet section 10A shown in FIG. 1A and an outlet section 10B shown in FIG. 1B. Generally, burner gun 10 includes a gas conduit 12 which extends from inlet section 10A to outlet section 10B and by which natural gas is transmitted from the inlet section to the outlet section.

In this regard, inlet section 10A includes a circumferential inlet flange 14 which is in fluid communication with gas conduit 12 and which has an inlet opening 16 through which natural gas is supplied under pressure to gas conduit 12. It is to be appreciated, however, that the configuration of inlet flange 14 and opening 16 may be varied, for example, as shown in U.S. Pat. No. 4,285,664 to the same applicant, the disclosure of the entire patent being incorporated herein by reference.

The natural gas supplied at inlet section 10A under pressure travels through gas conduit 12. In outlet section 10B, the natural gas passes through circumferentially arranged vanes 18. For example, three vanes 18 may be provided which are angularly separated by 120° and each of vanes 18 being angled at approximately 45° with respect to the longitudinal direction of flow of the natural gas so as to impart a spinning motion to the gas and thereby provide a more uniform gas mixture. The natural gas which passes through vanes 18 is then emitted from the burner gun through a burner nozzle assembly 20 according to the present invention at the outlet side of outlet section 10B.

Figure 4:
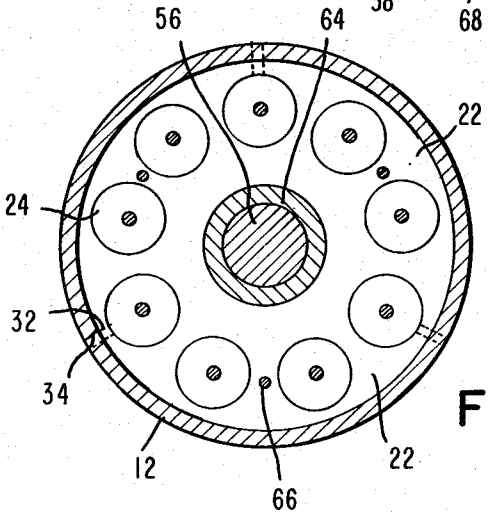
FIG. 4 is a partial cross-sectional, partial plan view of the upstream side of the burner nozzle assembly of FIG. 1B, taken along Line 4—4 thereof.

More particularly, burner nozzle assembly 20 includes an outlet plate 22 having a plurality of circumferentially arranged orifices 24 through which the natural gas is emitted from the burner gun. As shown in FIG. 4, nine equally spaced orifices 24 are provided. However, the number, spacing and size of the orifices may be varied depending upon the particular application. Outlet plate 22 snuggly slides within the outlet free end of gas conduit 12 and is provided with a shoulder 26 which abuts against the outlet edge 28 of gas conduit 12. For securing outlet plate 22 to gas conduit 12, a plurality of spring pins 30 are provided for connecting the concentrically arranged overlapping portions of outlet plate 22 and gas conduit 12 through respective aligned apertures 32 and 34 therein.

In accordance with an aspect of this invention, a plurality of orifice plugs 36 corresponding in number to orifices 24 and each associated with a respective orifice 24 are simultaneously controlled for movement in the longitudinal direction of gas conduit 12 for varying the inlet opening dimensions of orifices 24. As a result, the gas velocity, and thereby the gas pressure, of the gas exiting from burner gun 10 can be accurately and readily controlled.

More particularly, orifice plugs 36 are secured within respective end apertures 38 in the end face 40 of an adjusting cylinder 42. As shown in the drawings, each orifice plug 36 is formed in a frusto-conical section 44 which converges toward the smaller diameter end thereof from the larger diameter end thereof which has a dimension at least as great as the opening of the respective orifice 24 and is of a greater diameter than the respective end aperture 38 within which it fits. Each orifice plug 36 further includes a stem 46 which is connected to and extends from the large diameter end of frusto-conical section 44 and has an axis concentric with the axis of frusto-conical section 44. Each stem 46 is inserted within a respective end aperture 38 and is secured therein by a spring pin 48 which extends through respective aligned apertures 50 and 52 in cylinder 42 and stem 46. It is to be noted that, when orifice plug 36 is secured within the respective end aperture 38, the large diameter end face thereof is in abutting or substantially abutting relation with end face 40 of cylinder 42.

Figure 3:
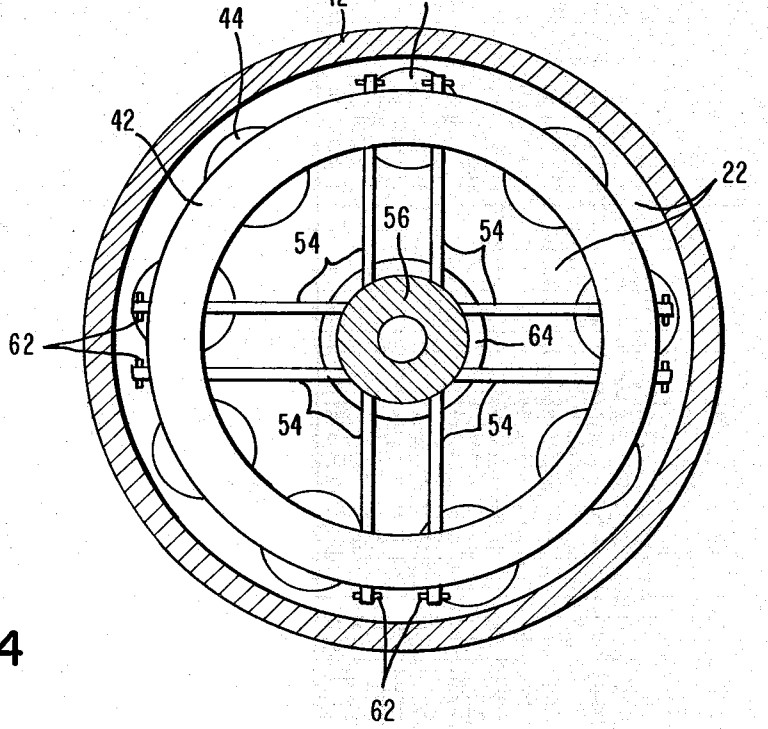
FIG. 3 is a partial cross-sectional, partial plan view of the upstream side of the burner nozzle assembly of FIG. 1B, taken along line 3—3 thereof.

For centering adjustable cylinder 42 and orifice plugs 36 with respect to outlet plate 22 and orifices 24, two sets of parallel thrust rods 54 are provided, the thrust rods 54 of each set being substantially orthogonal to the thrust rods 54 of the other set. Further, a piston-rod end piece guide 56 is provided with a circumferential groove 58. Thrust rods 54 of one set, for example, the vertically-arranged set shown in FIGS. 1B and 3, are positioned on opposite sides of guide 56 within groove 58 and at one end of groove 58, while the other set of horizontally-arranged thrust rods 54 are also positioned on opposite sides of guide 56 within groove 58 and at the opposite end of groove 58 adjacent the vertically-arranged thrust rods 54. Thrust rods 54 extend through substantially diametrically opposite apertures 60 at the end of cylinder 42 opposite end face 40 and are prevented from escaping therefrom by means of spring pins 62 at opposite ends of each thrust rod 54 externally of cylinder 42. It is to be noted that thrust rods 54 are of a sufficiently rigid material such that cylinder 42 is positioned by corresponding positioning of guide 56.

In this regard, outlet plate 22 has a guide sleeve 64 secured centrally therein, guide sleeve 64 having an internal diameter slightly larger than the external diameter of guide 56. In this manner, guide 56 is slidably received within guide sleeve 64 for sliding movement therein. It is to be appreciated that guide sleeve 64 thereby serves a two-fold purpose, namely, accurate positioning of orifice plugs 36 with respect to the respective orifices 24 and also enabling sliding movement of adjustable cylinder 42, and thereby orifice plugs 36, with respect to orifices 24 to vary the openings of the latter.

Figure 2:
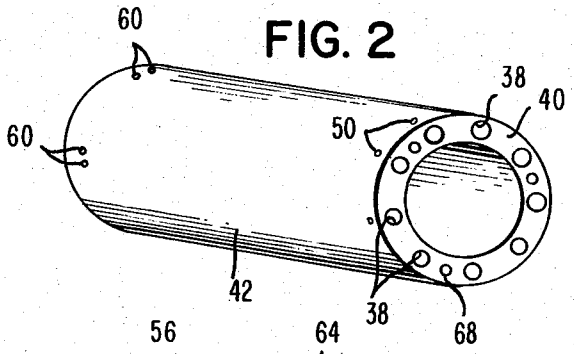
FIG. 2 is a perspective view of the pressure adjusting cylinder in the upstream side of the burner nozzle assembly of FIG. 1B.

To provide further stable alignment of adjustable cylinder 42 and orifice plugs 36 with respect to orifices 24, outlet plate 22 is provided with dowel pins 66 extending axially therefrom and positioned along the circumference of apertures 24 and positioned therebetween, as shown in FIGS. 1B and 4. End face 40 of cylinder 42 is provided with corresponding apertures 68 for receiving dowel pins 66, as shown in FIGS. 1B and 2, so as to provide accurate alignment of orifice plugs 36 with respect to orifices 24.

It is to be appreciated that, with the arrangement described thus far, orifice plugs 36 are slidably movable in the longitudinal or axial direction with respect to orifices 24 to vary the openings of the latter. In this manner, the pressure and velocity of the gas exiting from the burner gun can be accurately, easily and uniformly controlled.

In addition, it is to be noted that, as the constant pressure, constant velocity gas exits from orifices 24, there is a bluff body effect created by the central portion of the outer end face of outlet plate 22, which provides enhanced mixing and uniformity of the gas. As a result, because of the combination constant pressure-constant velocity gas through a multiplicity of orifices and due to the bluff body effect, there is positive retention of the flame which is useable within the practical range of industrially available gas pressures, that is, from 5 PSI to 50 PSI. Thus, with constant pressure established, gas flow can be varied over an extremely wide range, for example, suitable for drying refractory to instances where a high fire is desired, in a lime sludge kiln.

It is to be noted that there is also somewhat of a bluff body effect from the orifice plugs 36 themselves. However, the main bluff body effect is created by the central portion of the outer end face of outlet plate 22 in combination with the constant pressure, constant velocity gas exiting from orifices 24.

It is to be appreciated that, in each rotary kiln, there is an optimum gas velocity at which Brownian movement and heat radiation are at optimum values. It is therefore desirable to determine the optimum gas velocity during operation of the burner.

In accordance with another aspect of this invention, axially sliding movement of orifice plugs 36 can be externally adjusted during operation. More particularly, the end of guide 56 opposite that slidably received within guide sleeve 64 is provided with an axially arranged aperture 70 which receives the distal end of a rod 72. A spring pin 76 is inserted within aligned apertures 71 and 74 in guide 56 and rod 72 for securing the distal end of rod 72 to guide 56. As shown in FIGS. 1A and 1B, rod 72 extends from guide 56 where it is secured at its opposite end to a piston rod regulator body 78 which extends through a central aperture 80 of an outer gas gun flange 82 to which circumferential inlet flange 14 is secured. Rod 72 is concentrically surrounded with a rod extension support tube 84. At outlet section 10B, a bushing 86 is provided at the end of support tube 84 for supporting rod 72. The opposite end of support tube 84 is provided with a central axial aperture 88 through which piston rod regulator body 78 extends. In addition, support tube 84 is supported in outlet section 10B by means of the aforementioned circumferentially arranged vanes 18 which are connected between the inner wall of gas conduit 12 and the outer wall of support tube 84 so as to centrally position support tube 84 and thereby rod 72.

Referring to FIG. 1A, regulator body 78 extends from rod 72 through aperture 88 of support tube 84 and is received within an aperture 90 of a knob 92. Knob 92 is formed with a grasping section 94 of a generally cylindrical configuration and with an axial extension 96 projecting centrally therefrom and which contains aperture 90. Both regulator body 78 and axial extension 96 contain respective apertures 98 and 100 such that when regulator body 78 is positioned within aperture 90, a spring pin 102 extends within apertures 98 and 100 to lock knob 92 securely onto regulator body 78.

A regulator body 104 is secured to the opposite side of gun flange 82 and includes a central aperture 106 through which regulator body 78 extends. Regulator body 104 is formed in a generally cup-shaped configuration which is positioned on its side and includes a teflon wedge packing 108 inside the cup-like configuration and which is in surrounding relation to regulator body 78. A gland 110 is secured within the cup-like configuration of regulator body 104 by means of a screw-threaded arrangement, as shown in FIG. 1A and includes a central axial aperture 112 having screw threads along the length thereof. Regulator body 78 extends through aperture 112 and is provided with corresponding screw threads 114.

With this arrangement, when knob 92 is rotated, as a results of screw threads 114 and screw-threaded aperture 112, rod 72 is moved axially. As a result, guide 56 axially slides within guide sleeve 64. As guide 56 moves in the axial direction thereof, thrust rods 54 control adjustable cylinder 42 and orifice plugs 36 to move in the same axial direction with respect to orifices 24 to adjust the opening thereof. Accordingly, during operation of the burner gun according to the present invention, the gas velocity can be accurately controlled to provide optimum heating characteristics of the burner's flame envelope. It is to be appreciated that knob 92 and the corresponding structure are externally controllable during operation of the apparatus.

An extension 116 secured to knob 92 can be provided for motorized operation in response to an input signal, for example, from a computer programmable controller or the like.

As an example of suitable dimensions that can be used, the distance from the external end face of outlet plate 22 to the end face of support tube 84 is 9 inches, the distance from the end face of support tube 84 to vanes 18 is 3 inches and the distance from the external end face of outlet plate 22 to the internal end face of gun flange 82 is 12 feet 5 inches.

Having described a specific preferred embodiment of the invention with reference to the accompanying drawings, it is to be understood that the present invention is not limited to that precise embodiment and that various changes and modifications may be effected therein by one of ordinary skill in the art within the spirit and scope of the present invention as defined by the appended claims.

What is claimed is:

1. A gas nozzle for a burner gun comprising:

conduit means having an inlet and an outlet;

gas inlet means for supplying a gas to said inlet of said conduit means;

gas outlet means extending completely across said outlet of said conduit means for emitting said gas supplied to said conduit means, said gas outlet means including a circular outlet plate having an outer surface exterior to the interior of said conduit means and a plurality of cylindrical orifices extending through said outlet plate only about a single circle adjacent the outer periphery of said circular outlet plate, said outer surface including an uninterrupted, substantially circular central portion surrounded and defined by said orifices and operative as bluff body means, and the thickness of the outlet plate is greater than the diameters of said orifices;

plurality of orifice plugs, each axially adjustable within said conduit means with respect to a respective one of said orifices;

control means for simultaneously adjusting said plurality of orifice plugs with respect to said plurality of orifices to vary the openings of said plurality of orifices so as to provide a constant gas velocity at the outlet of said conduit means, said control means including hollow cylinder means having a first end surface to which said plurality of orifice plugs are secured and rod means secured to said cylinder means for simultaneously adjusting said plurality of orifice plugs.

2. A gas nozzle according to claim 1; in which each of said orifice plugs has a frusto-conical configuration.

3. A gas nozzle according to claim 1; in which said outlet plate includes positioning means; and said control means includes guide means connected to said cylinder means, said guide means cooperating with said positioning means to accurately position said plurality of orifice plugs with respect to said respective plurality of orifices.

4. A gas nozzle according to claim 1; in which said central portion is substantially flat.

5. A gas nozzle for a burner gun comprising:

conduit means having an inlet and an outlet;

gas inlet means for supplying a gas to said inlet of said conduit means;

gas outlet means extending completely across said outlet of said conduit means for emitting said gas supplied to said conduit means, said gas outlet means including an outlet plate having an outer surface exterior to the interior of said conduit means, positioning means and a plurality of circumferentially arranged cylindrical orifices extending therethrough, said outer surface including a central portion surrounded by said orifices and operative as bluff body means, and said positioning means including guide sleeve means secured to said outlet plate;

a plurality of orifice plugs, each axially adjustable with respect to a respective one of said orifices; and control means for simultaneously adjusting said plurality of orifice plugs with respect to said plurality of orifices to vary the openings of said plurality of orifices so as to provide a constant gas velocity at the outlet of said conduit means, said control means including hollow cylinder means having a first end surface to which said plurality of orifice plugs are secured, rod means secured to said cylinder means for simultaneously adjusting said plurality of orifice plugs, and guide means connected to said cylinder means and cooperating with said positioning means to accurately position said plurality of orifice plugs with respect to said respective plurality of orifices, said guide means including guide rod means slidably positioned within said guide sleeve means and centrally connected to said cylinder means.

6. A gas nozzle according to claim 5; in which said control means further includes thrust rod means for connecting said guide rod means to said cylinder means along an axis concentric with the central axis of said cylinder means.

7. A gas nozzle according to claim 6; in which said rod means is directly connected to said guide rod means and indirectly connected to said cylinder means through said guide rod means and said thrust rod means, and further including rod adjusting means for axially moving said rod means so as to control said axial movement of said plurality of orifice plugs with respect to said plurality of orifices.

8. A gas nozzle according to claim 7; in which said rod adjusting means is positioned externally of said burner gun for axially adjusting said plurality of said orifice plugs with respect to said plurality of orifices during operation of said burner gun.

9. In a burner gun of the type having conduit means with a gas inlet and a gas outlet, a gas nozzle assembly comprising:

gas outlet means extending completely across said gas outlet for emitting said gas supplied to said conduit means, said gas outlet means including an outlet plate having an outer surface exterior to the interior of said conduit means and a plurality of cylindrical orifices extending through said outlet plate only about a single circle adjacent the outer periphery of said circular outlet plate, and said outer surface including an uninterrupted, substantially circular central portion surrounded and defined by said orifices and operative as bluff body means;

a plurality of orifice plugs, each axially adjustable within said conduit means with respect to a respective one of said orifices; and control means for simultaneously adjusting said plurality of orifice plugs with respect to said plurality of orifices to vary the openings of said plurality of orifices so as to provide a constant gas velocity at the outlet of said conduit means, said control means including hollow cylinder means having a first end surface to which said plurality of orifice plugs are secured and rod means secured to said cylinder means for simultaneously adjusting said plurality of orifice plugs.

10. A gas nozzle assembly according to claim 9; in which each of said orifice plugs has a frusto-conical configuration.

11. A gas nozzle assembly according to claim 9; in which said outlet plate includes positioning means; and said control means includes guide means connected to said cylinder means, said guide means cooperating with said positioning means to accurately position said plurality of orifice plugs with respect to said respective plurality of orifices.

12. A gas nozzle assembly according to claim 9; in which said central portion is substantially flat.

13. In a burner gun of the type having conduit means with a gas inlet and a gas outlet, a gas nozzle assembly comprising:

gas outlet means extending completely across said gas outlet for emitting said gas supplied to said conduit means, said gas outlet means including an outlet plate having an outer surface exterior to the interior of said conduit means, positioning means and a plurality of circumferentially arranged orifices extending therethrough, and said outer surface including a central portion surrounded by said orifices and operative as bluff body means, and said positioning means includes guide sleeve means secured to said outlet plate;

a plurality of orifice plugs, each axially adjustable within said conduit means with respect to a respective one of said orifices; and control means for simultaneously adjusting said plurality of orifice plugs with respect to said plurality of orifices to vary the openings of said plurality of orifices so as to provide a constant gas velocity at the outlet of said conduit means, said control means including hollow cylinder means having a first end surface to which said plurality of orifice plugs are secured and rod means secured to said cylinder means for simultaneously adjusting said plurality of orifice plugs, and guide means connected to said cylinder means and cooperating with said positioning means to accurately position said plurality of orifice plugs with respect to said respective plurality of orifices, said guide means including guide rod means slidably positioned within said guide sleeve means and centrally connected to said cylinder means.

14. A gas nozzle assembly according to claim 13; in which said control means further includes thrust rod means for connecting said guide rod means to said cylinder means along an axis concentric with the central axis of said cylinder means.

15. A gas nozzle assembly according to claim 14; in which said rod means is directly connected to said guide rod means and indirectly connected to said cylinder means through said guide rod means and said thrust rod means, and rod adjusting means for axially moving said rod means so as to control said axial movement of said plurality of orifice plugs with respect to said plurality of orifices.

16. A gas nozzle assembly according to claim 15; in which said rod adjusting means is positioned externally of said burner gun for axially adjusting said plurality of said orifice plugs with respect to said plurality of orifice during operation of said burner gun.

17. A gas nozzle for a burner gun comprising:

conduit means having an inlet and an outlet;

gas inlet means for supplying a gas to said inlet of said conduit means;

gas outlet means extending completely across said outlet of said conduit means for emitting said gas supplied to said conduit means, said gas outlet means including a circular outlet plate having an outer surface exterior to the interior of said conduit means and a plurality of cylindrical orifices extending through said outlet plate only about a single outer circle adjacent the outer periphery of said circular outlet plate, said outer surface including positioning means and an uninterrupted, substantially circular central portion surrounded and defined by said orifices and operative as bluff body means, and the thickness of the outlet plate is greater than the diameters of said orifices;

a plurality of orifice plugs, each axially adjustable within said conduit means with respect to a respective one of said orifices;

control means for simultaneously adjusting said plurality of orifice plugs with respect to said plurality of orifices to vary the openings of said plurality of orifices so as to provide a constant gas velocity at the outlet of said conduit means, said control means including hollow cylinder means having a first end surface to which said plurality of orifice plugs are secured, rod means secured to said cylinder means for simultaneously adjusting said plurality of orifice plugs, and guide means connected to said cylinder means, said guide means cooperating with said positioning means to accurately position said plurality of orifice plugs with respect to said respective plurality of orifices; and at least one aperture arranged in one of said outlet plate and said first end wall of said cylinder means, and at least one dowel means mounted to the other of said outlet plate and said first end wall of said cylinder means for mating engagement with said at least one aperture.

18. In a burner gun of the type having conduit means with a gas inlet and a gas outlet, a gas nozzle assembly comprising:

gas outlet means extending completely across said gas outlet for emitting said gas supplied to said conduit means, said gas outlet means including an outlet plate having an outer surface exterior to the interior of said conduit means and a plurality of cylindrical orifices extending through said outlet plate only about a single outer circle adjacent the outer periphery of said circular outlet plate, and said outer surface including positioning means and an uninterrupted, substantially circular central portion surrounded and defined by said orifices and operative as bluff body means;

a plurality of orifice plugs, each axially adjustable within said conduit means with respect to a respective one of said orifices; and control means for simultaneously adjusting said plurality of orifice plugs with respect to said plurality of orifices to vary the openings of said plurality of orifices so as to provide a constant gas velocity at the outlet of said conduit means, said control means including hollow cylinder means having a first end surface to which said plurality of orifice plugs are securde, rod means secured to said cylinder means for simultaneously adjusing said plurality of orifice plugs, and guide means connected to said cylinder means, said guide means cooperating with said positioning means to accurately position said plurality of orifice plugs with respect to said respective plurality of orifices; and at least one aperture arranged in one of said outlet plate means and said first end wall of said cylinder means, and at least one dowel means mounted to the other of said outlet plate means and said first end wall of said cylinder means for mating engagement with said at least one aperture.

* * * * *